United States Patent [19]

McCallum

[11] 4,130,181

[45] Dec. 19, 1978

[54] LADDER SUPPORT SYSTEM

[76] Inventor: William J. P. McCallum, R.R. #2, Hillsburgh, Ontario, Canada, N0B 1Z0

[21] Appl. No.: 800,520

[22] Filed: May 25, 1977

[51] Int. Cl.[2] ..... E06C 1/20

[52] U.S. Cl. ..... 182/169; 182/107

[58] Field of Search ..... 182/170, 172, 165, 174, 182/169, 107, 108; 248/351, 356, 357

[56] References Cited

U.S. PATENT DOCUMENTS

| | | | |
|---|---|---|---|
| 767,257 | 8/1904 | Banks | 182/169 |
| 2,652,184 | 9/1953 | Loucks | 182/169 |
| 2,997,127 | 8/1961 | Wojtowicz | 182/172 |

FOREIGN PATENT DOCUMENTS

| | | | |
|---|---|---|---|
| 126132 | 9/1927 | Switzerland | 182/165 |
| 127470 | 9/1928 | Switzerland | 182/165 |

*Primary Examiner*—Reinaldo P. Machado

[57] ABSTRACT

A support strut arrangement for use with a ladder extends from the ladder in load transfer relation with the ground, having lost motion provision to accept a predetermined extent of bowing of the ladder under the weight of a user before the load strut becomes effective, so that the top ends of the ladder may be in substantially unrestricted pressing relation against the supporting wall or other object, thereby permitting the development of substantially maximum friction forces tending in normal use to maintain the tip of the ladder in its propped position. In the event that the foot of the ladder slips out the lost motion, in the form of an extensible tension member or of a strut which can shorten its effective length, is taken up and substantially rigid triangulation of forces is established. This force triangulation between the lower end of the ladder, the lower end of the strut and the point of attachment of the strut to the ladder produces a stabilizing effect against further slippage and provides greatly enhanced safety.

1 Claim, 6 Drawing Figures

LADDER SUPPORT SYSTEM

This invention is directed to a ladder device, and in particular to a ladder safety prop strut for use with a plain ladder, to enhance the safety of a user when mounted on the ladder.

In use, ladders as a scaling device for ascending to or working at a height are notoriously unsafe. Under the varied conditions encountered in use it is not uncommon for the foot of a ladder to slip away under the applied load. Conversely because of the danger of such slip away, users often overcompensate by raising the ladder to a position precariouly close to the vertical, sometimes resulting in a tip-over.

Certain attempts have been made in the past to over come the recited disadvantages of ladder usage. A particular solution advanced by Housak in his U.S. Pat. No. 1,521,814, issued Jan. 6, 1925 is the provision of a rigid strut pivotally secured to the ladder intermediate the ends thereof, and braced to the bottom of the ladder to provide appropriate positioning by means of an adjustable radius arm. A major problem presented by such a device is that in use the approximate mid-point of the ladder is effectively rigidly located in space, relative to the supporting terrain surface. Accordingly, the ladder is incapable of deflecting in a normal fashion, so as to apply full load component against the supporting wall or other upper surface supporting the top end of the ladder. As a consequence, the top of the ladder is effectively prevented from developing a reaction force and consequent transverse and vertical friction forces proportional to the applied load.

An object of the present invention is the provision of a ladder stabilising device having a lost motion connection to permit deveopment of full reaction support forces during normal use, and to provide additional support under conditions of slip-out.

In a first embodiment the stabilising strut per se is connected between the ladder and ground close to the wall or support structure by way of a lost motion connection, thus permitting predetermined deflection of the ladder in use. The invention provides a triangulation means to secure the lower end of the stabilising strut in a manner permitting limited displace ment thereof away from the ladder, for the purpose of permitting bowing of the ladder under load to a predetermined extent. This triangulation may comprise a resilient tie extending between the foot of the bracing strut or lower region and the bottom of the ladder or lower region of the ladder such as a nylon rope of predetermined extensibility under load.

Certain embodiments of the invention are described, reference being made to the accompanying drawings, wherein.

Figure 1:
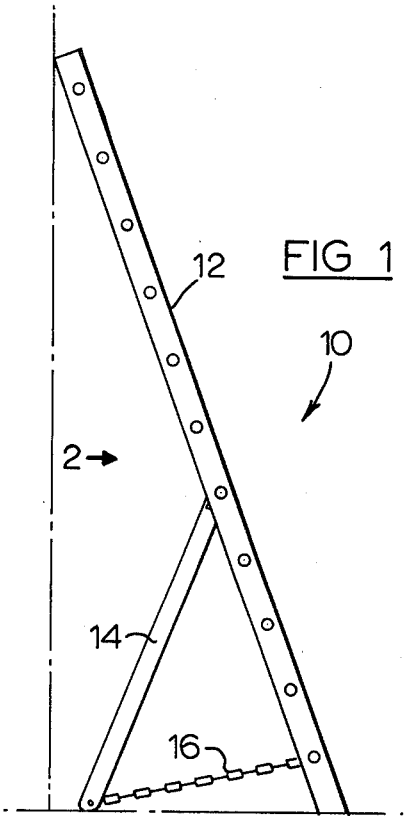
FIG. 1 is a side view of a ladder attached with one embodiment of a brace strut in accordance with the present invention.

Referring first to FIGS. 1–4, the ladder support device 10 is attached to ladder 12 propped against a wall for use. In the condition shown in FIGS. 1, 2 and 3, the device is in position but has not become operative. Accordingly, with a load on the ladder such as a user the reaction forces acting on the ladder, at the bottom due to the ground, and at the top of the ladder due to the wall, are fully developed forces, so that frictional forces acting to maintain the ladder in its location are not reduced from their optimum values.

The elements of FIGS. 1–4 comprise a substantially incompressible strut 14 attached by a substantially inextensible tension member 16, shown as a chain, to the foot of the ladder. The strut 14 has a T-piece of U-section, to receive a rung 20 of the ladder therein, or alternatively, a universal sized set of affixed flanges to come close to the inner sides of the ladder rails and rest close to and under a rung. A securing bracket 22 has a pivotted latch position 24 thereon resiliently biassed to a closed position by spring means (not shown) or simply shaped from spring metal to permit entry of a rung 20 therepast into secured relation within bracket 22.

Figure 2:
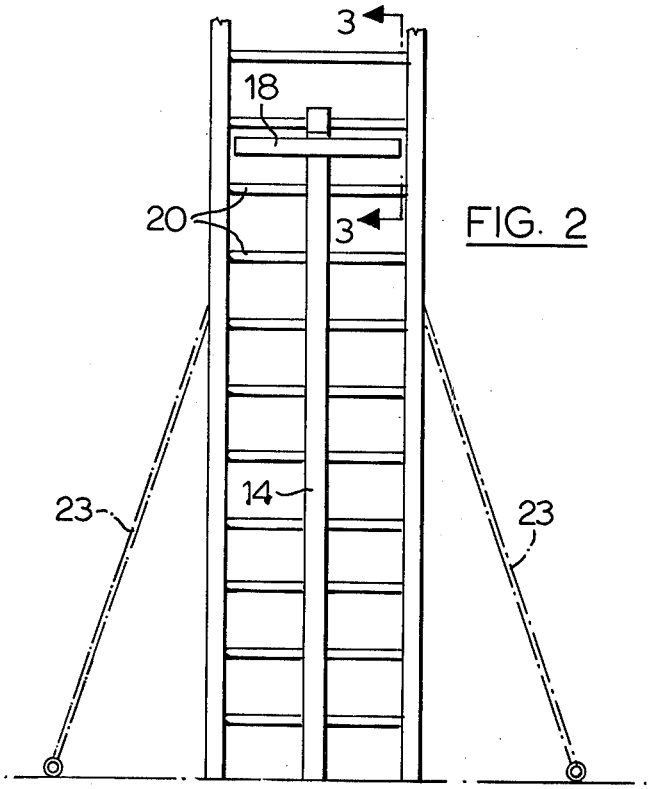
FIG. 2 is a rear view from the direction 2 of the arrangement of FIG. 1, with the inclusion of guys.
Figure 3:
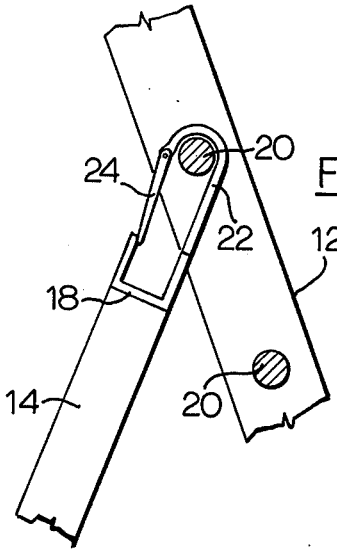
FIG. 3 is an enlarged section view at 3—3 of FIG. 2 with the strut device inoperative.

The provision 23 of FIG. 2 may comprise guy ropes for lateral stabilisation or alternatively comprises a pair of struts in accordance with the present invention, providing additional triangulation of stabilising forces.

Figure 4:
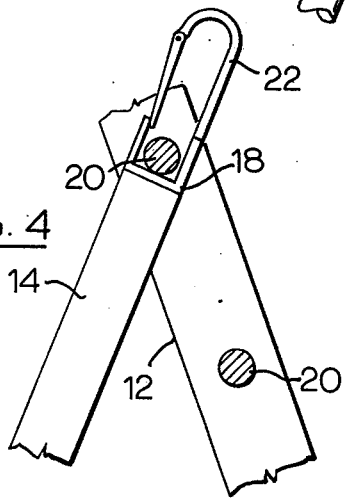
FIG. 4 is a view similar to FIG. 3, with the device operative.

In use, if the foot of the ladder slips out, the engaged rung 20 bottoms in the T-piece 18 as shown in FIG. 4 and receives support therefrom, the supporting force having a large component acting upwardly along the ladder to arrest further slip-out, together with a tension component holding the foot of the ladder against outward movement.

Figure 5:
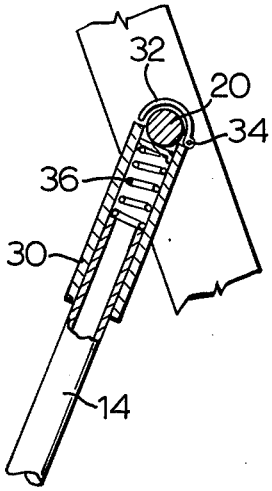
FIG. 5 is a view corresponding to FIGS. 3 and 4 of a further embodiment of the device.

FIG. 5 shows another embodiment wherein the strut 14 has an attachment head comprising an outer sleeve 30 having an enclosure member or latch 32 attached in spring loaded relation at 34 to retain the strut in attached relation to the rung 20. A spring 36 mounted in compressible relation between sleeve 30 and the lower portion of strut 14 provides progressive loading to the engaged rung 20 in the event of ladder slip-out. The spring 36, which is optional, may be of selected characteristic, and transmits full load when compressed to a solid condition.

Figure 6:
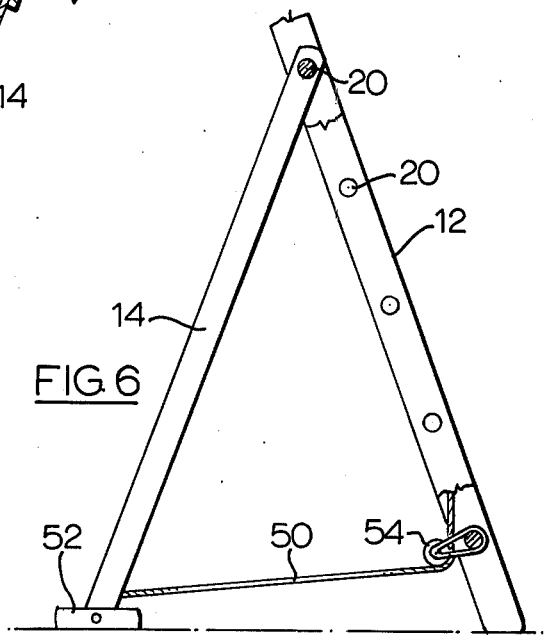
FIG. 6 shows particulars of portions of another embodiment.

In the FIG. 6 embodiment a resilient rope 50 such as a nylon rope of desired elastic strength secures the foot of strut 14 to the bottom of the ladder. A skid 52 pivotally attached to the foot of strut 14 may be used to facilitate loading of the strut while decreasing the probability of displacing further the foot of the ladder. Provision of a pulley 54 attached to a lower rung permits a desired length of rope 50 to be used for achieving a desired rope resilience. Thus, by tying the rope 50 to a specified rung in an initially snug condition, the extent of ladder motion and degree of give in the strut 14 is predetermined. In the FIG. 6 embodiment the strut 14 is shown pivotally attached to a rung 20 of the ladder, with the lost motion provision afforded by the resiliently extensible rope 50, the effective length of which may be readily selectively adjusted from rung to rung. The pulley 54 tends to equalise the tension force within the rope 50 for consistent results, but is optional.

Also contemplated is the provision of a spring clip for attachment by snap action to a selected rung of the ladder, for purposes of securing the end of either the nylon rope, or the end of the chain, of the respective embodiments.

A further embodiment of the invention, referred to above in relation to FIGS. 1–4 comprises the provision of a pair of struts in mutually spread relation as guys, to afford triangulation of support in two mutually inclined vertical planes.

What I claim is:

1. Strut means for attachment to a ladder intermediate the ends thereof, to extend at a substantial angle between the ladder and the ground for transference of a significant supporting force between the ladder and the ground; tie means for connecting the strut means to the ladder adjacent the lower end thereof to provide triangulation of forces in a substantially vertical plane, when in use, and spring means permitting predetermined shortening of said strut means when under compression to permit predetermined limited bowing deflection of the ladder towards the ground under the weight of the user before the strut means becomes effective to transfer load from the ladder to the ground whereby the weight of a user is substantially fully applied in unrestricted relation to the upper end of the ladder, to develop optimum reaction and friction forces between the upper end of the ladder and a surface supporting said ladder upper end.

* * * * *